US007328952B2

(12) United States Patent
Guerrini

(10) Patent No.: US 7,328,952 B2
(45) Date of Patent: Feb. 12, 2008

(54) DETACHABLE SWIVEL APPARATUS FOR A BEACH CHAIR

(76) Inventor: Derrek Guerrini, 71 Gleason Ave., West Yarmouth, MA (US) 02673

( * ) Notice: Subject to any disclaimer, the term of this patent is extended or adjusted under 35 U.S.C. 154(b) by 92 days.

(21) Appl. No.: 11/403,124

(22) Filed: Apr. 13, 2006

(65) Prior Publication Data

US 2007/0241601 A1 Oct. 18, 2007

(51) Int. Cl.
*A47C 1/14* (2006.01)

(52) U.S. Cl. ..... 297/344.21; 297/344.26

(58) Field of Classification Search ..... 297/344.21, 297/344.26; 248/349.1, 425, 521
See application file for complete search history.

(56) References Cited

U.S. PATENT DOCUMENTS 5,580,129 A * 12/1996 Findlay ..... 297/344.21
6,315,360 B1 * 11/2001 Guerrini ..... 297/344.21
6,890,033 B1 * 5/2005 Casella ..... 297/344.21

* cited by examiner

*Primary Examiner*—Anthony D. Barfield
(74) *Attorney, Agent, or Firm*—Stephen R. Greiner

(57) ABSTRACT

A detachable swivel apparatus for a beach chair including a load-distributing platform for positioning upon the ground and saddle pivotally secured atop the platform. The saddle has a rectangular plate with a keyhole at each of its corners. A number of mounting clips are releasably secured to the saddle for grasping the legs of a beach chair. One of the clips is associated with each keyhole. Each of the clips has a pair of arcuate jaws for receiving and grasping therebetween one leg of a beach chair. A shaft is affixed to, and extends downwardly from, the jaws. A key bit is affixed to, and extends outwardly from, the bottom of the shaft. In use, the shaft and key bit of each of the clips can, in one angular orientation, be slid through a keyhole and, upon rotation to another angular orientation, be prevented from withdrawal through the keyhole.

5 Claims, 5 Drawing Sheets

DETACHABLE SWIVEL APPARATUS FOR A BEACH CHAIR

FIELD OF THE INVENTION

The present invention relates generally to chairs and seats and, in particular, to an apparatus for moving the bottom and back of a chair as a unit about a vertical axis.

BACKGROUND OF THE INVENTION

In U.S. Pat. No. 6,315,360, I described an apparatus that, during use, permitted a beach chair of conventional construction to be swiveled in the manner of a captain's chair. A person seated in a chair positioned upon the apparatus can, with minimal effort, turn in any direction. Such is particularly advantageous in keeping track of young and mobile children at a beach. Furthermore, sunbathing opportunities are enhanced since a user can swivel her body to always face the sun as it tracks across the sky. Away from the beach, the apparatus has been found useful at outdoor sporting events and barbeques.

Over time, enhancements to my original apparatus have occurred to me. For example, it has been found desirable to reinforce the already sturdy construction of my apparatus for greater longevity and stability during use. Additionally, instead of producing the apparatus in different sizes to accommodate different makes and models of beach chairs, I have concluded that making a single adjustable apparatus for universal attachment to beach chairs would increase the value of the apparatus to users.

SUMMARY OF THE INVENTION

In view of my desire to improve the structure of apparatus disclosed in U.S. Pat. No. 6,315,360, it is a principal object of the invention to provide a swivel apparatus that can be selectively attached to any one of a wide variety of makes and models of beach chairs. A user, without special tools or training, can quickly attach the swivel apparatus to a chair for use and detach the apparatus from the chair after use for transport and storage.

It is an object of the invention to provide improved features and arrangements of features in a swivel apparatus for the purposes described that is lightweight in construction, compact in size, easy to transport, inexpensive to manufacture, and fully dependable in use.

The apparatus in accordance with this invention achieves the intended objects by featuring a platform and a saddle pivotally secured atop the platform. The saddle has a plate with a pair of mounting clip receivers at each corner thereof. Each of the mounting clip receivers includes: a tubular sleeve that extends downwardly from the plate; a recessed plug that closes the top of the sleeve and has a keyhole therein; and a pair of ramps affixed to the plug and located on opposite sides of the keyhole with a pair of key bit keepers positioned at the thick, central portions of each of the ramps. A number mounting clips are releasably secured to the saddle for grasping the legs of a beach chair with one of the clips being associated with each pair of mounting clip receivers. Each of the clips includes: a pair of arcuate jaws for receiving and grasping one leg of a beach chair; a shaft extending from the jaws; and a key bit extending from the shaft. In use, the shaft and key bit of a given clip can, in one angular orientation, be slid through a respective one of the keyholes and, upon rotation to another angular orientation after being slid through a respective one of the keyholes, be prevented from withdrawing through a respective one of the keyholes thereby locking the clip to the saddle.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
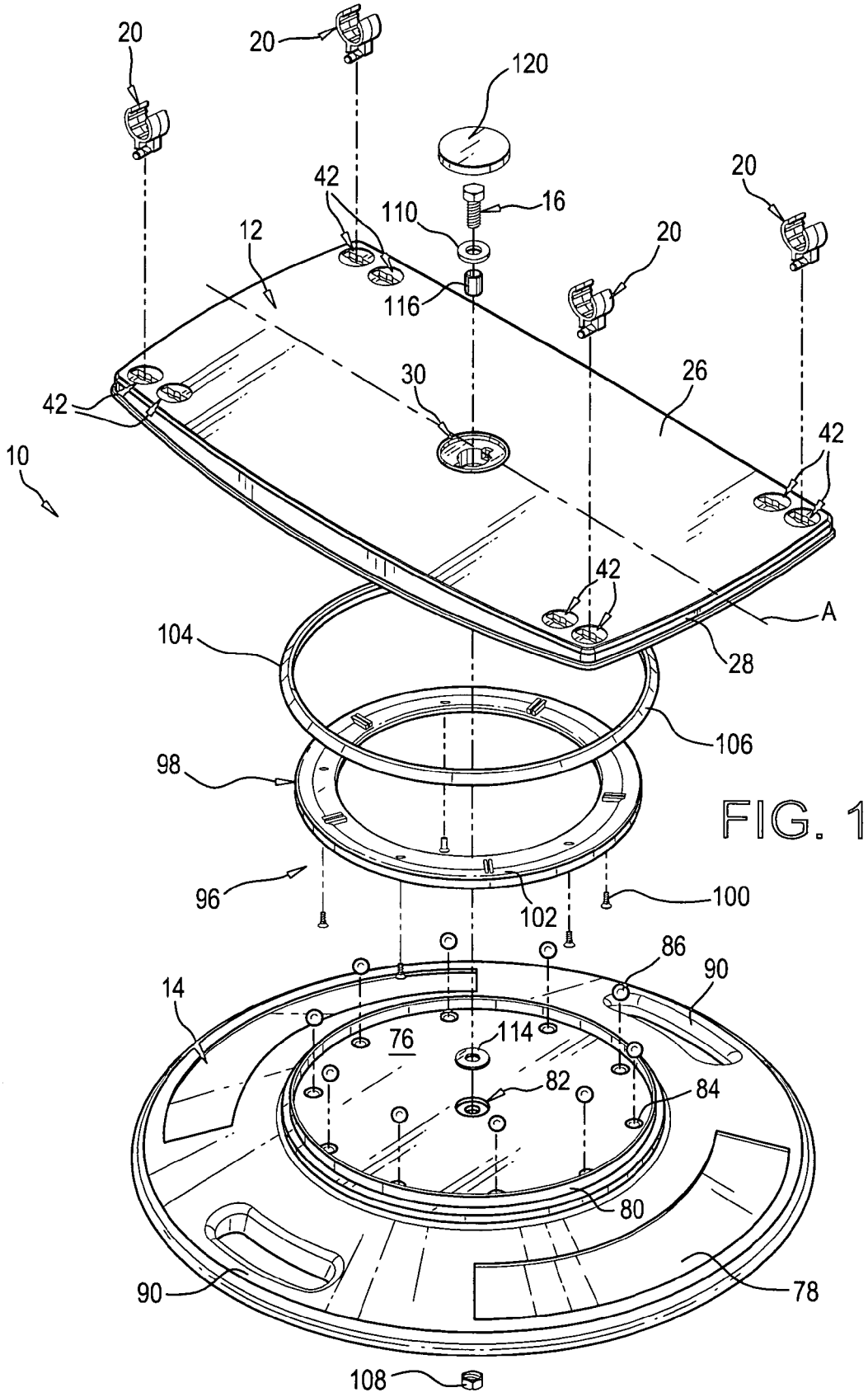
FIG. 1 is an exploded perspective view of a detachable swivel apparatus for a beach chair in accordance with the present invention.
Figure 2:
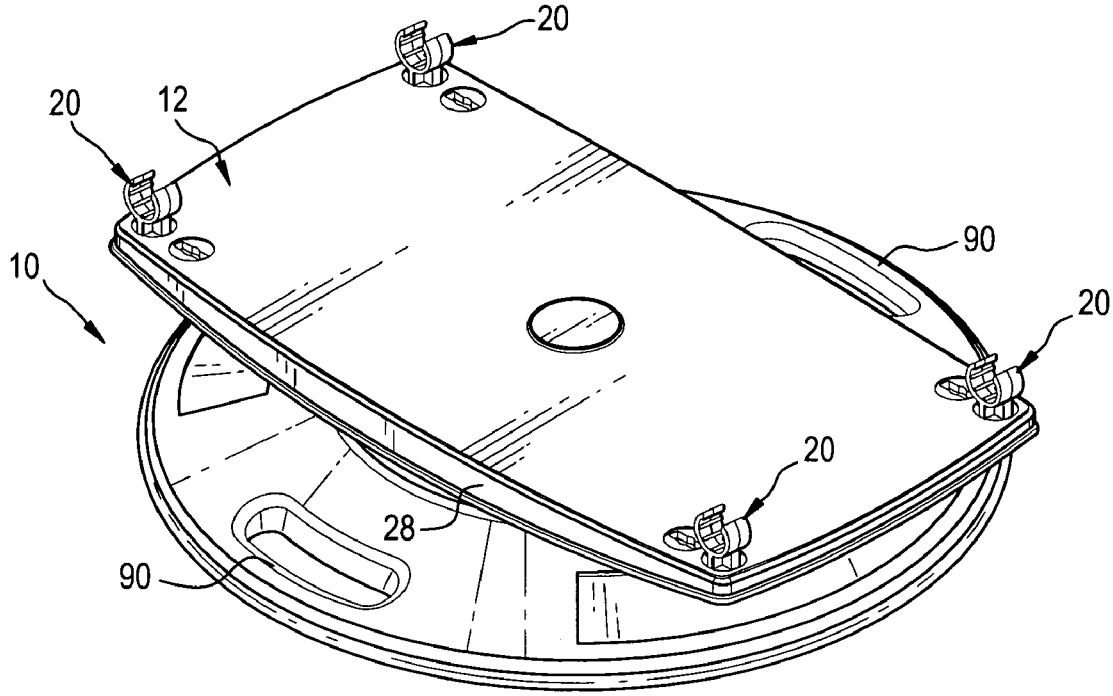
FIG. 2 is a perspective view of the detachable swivel apparatus of FIG. 1.
Figure 3:
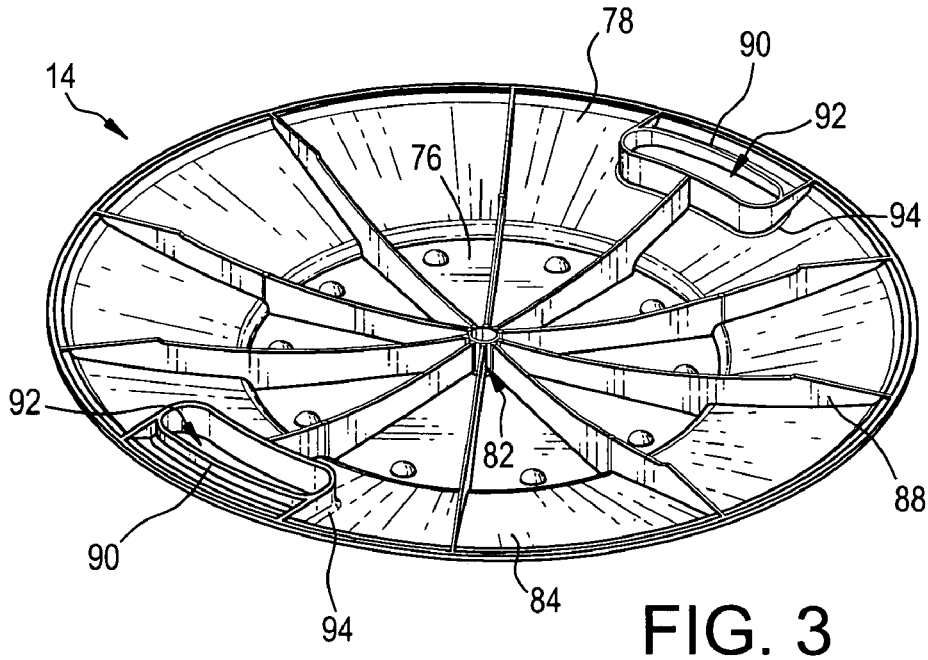
FIG. 3 is a perspective view of the inverted platform of the swivel apparatus.
Figure 4:
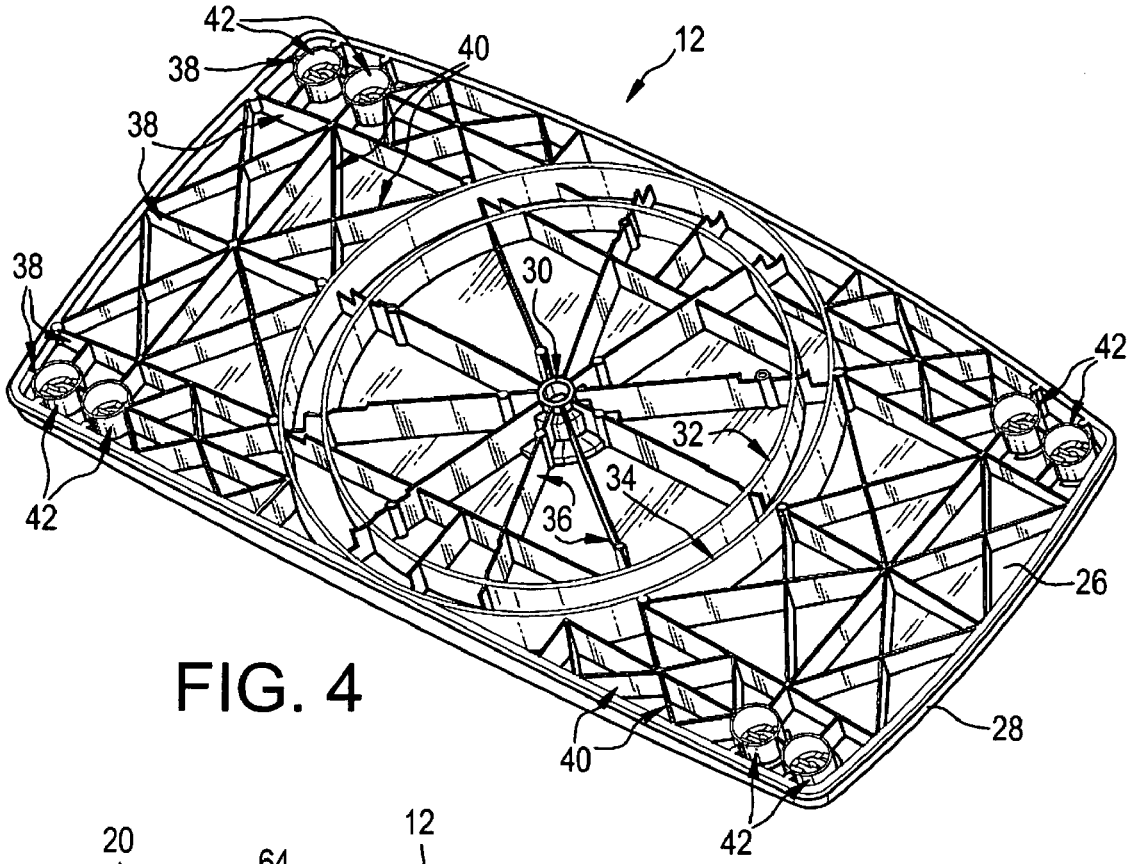
FIG. 4 is a perspective view of the inverted saddle of the swivel apparatus.
Figure 5:
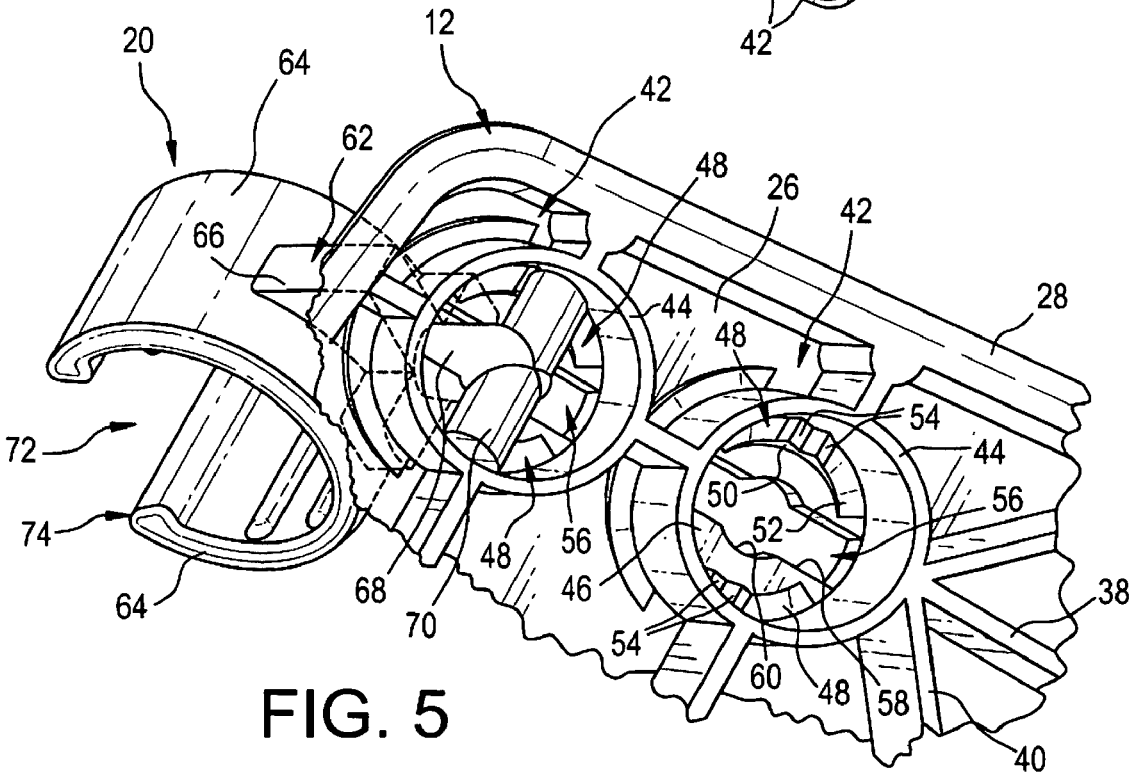
FIG. 5 is an enlarged perspective view of one corner of the inverted saddle of FIG. 4.
Figure 6:
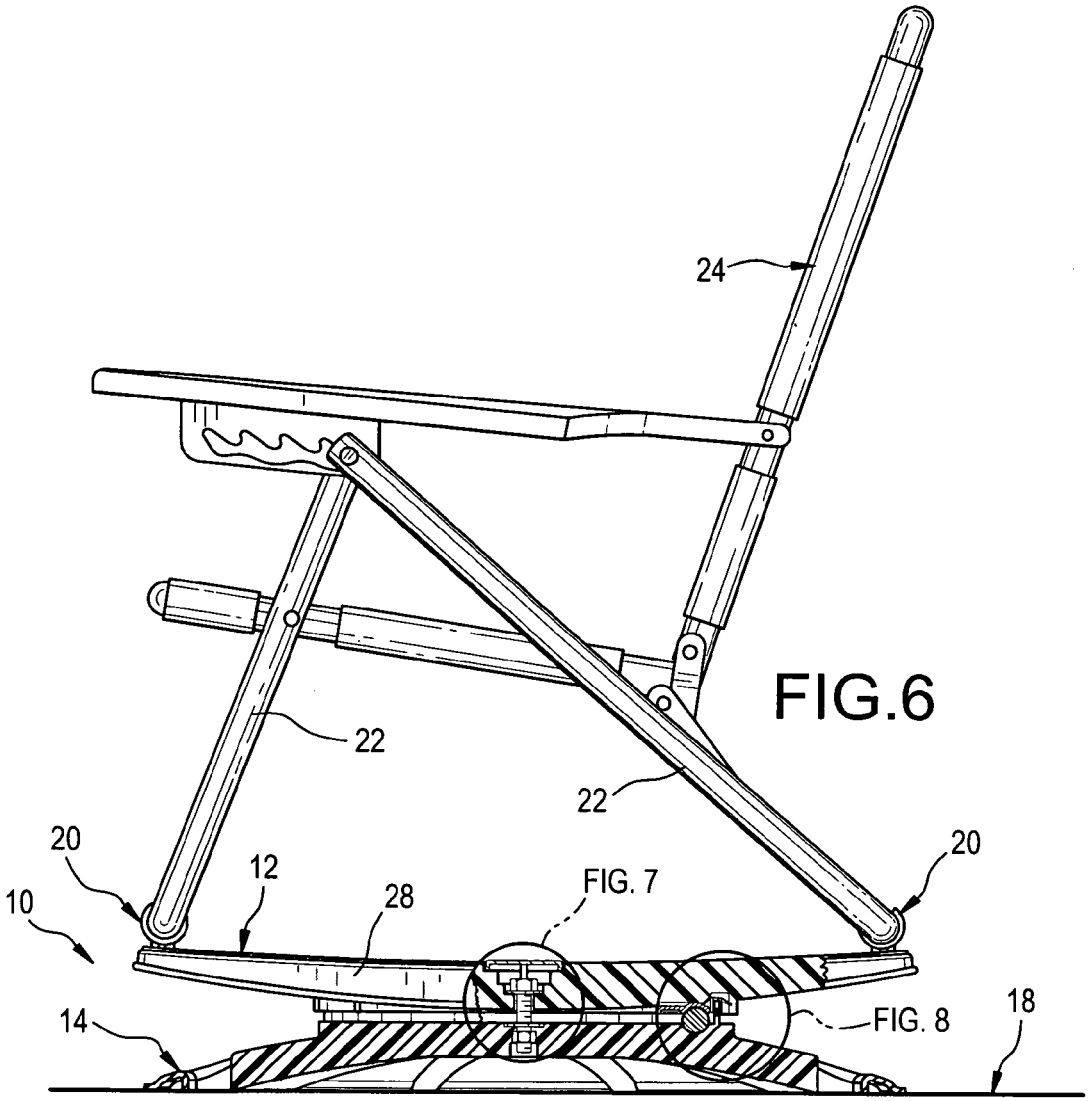
FIG. 6 is a side elevational view of the swivel apparatus, with portions broken away to reveal details thereof, shown supporting a collapsible beach chair.
Figure 7:
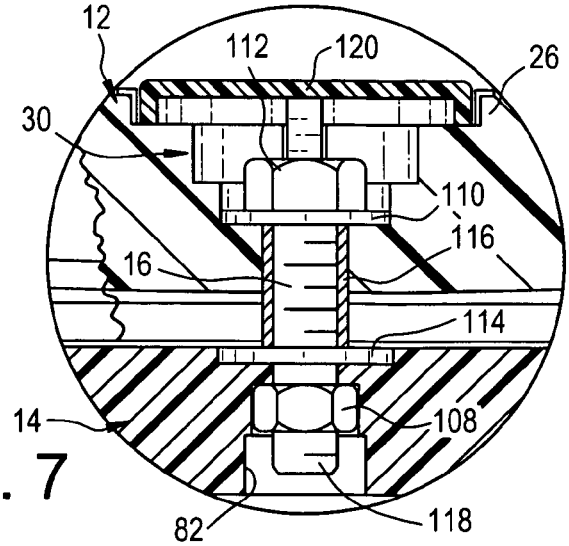
FIG. 7 is an enlarged view of the circled portion at the center of FIG. 6.
Figure 8:
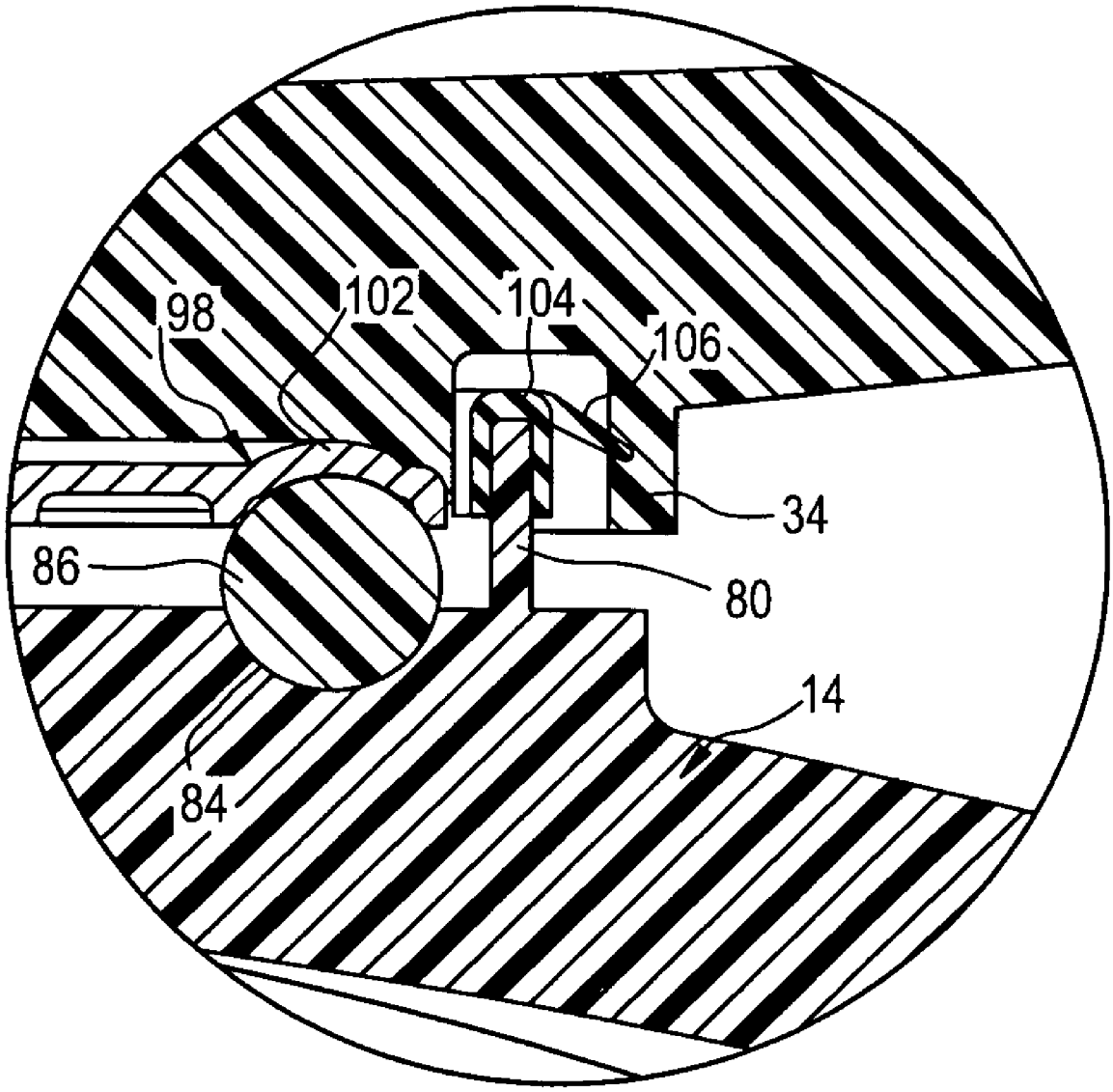
FIG. 8 is an enlarged view of the circled portion at the right of FIG. 6.

Referring now to the FIGS., a swivel apparatus in accordance with the present invention is shown at 10. Apparatus 10 includes a saddle 12 attached to a load-distributing platform 14 by a pivot pin 16 that permits saddle 12 to rotate about a vertical axis when platform 14 is positioned upon a horizontal supporting surface 18. A number of mounting clips 20 extend upwardly from saddle 12 for releasably grasping the legs 22 of a beach chair 24. In use, chair legs 22 are fastened by clips 20 to the top of saddle 12 thereby permitting the rotating of chair 24 relative to platform 14.

Saddle 12 includes a rectangular plate 26 having a downwardly extending lip 28 about its periphery. At the center of plate 26 is located a pivot pin receiver 30. Surrounding pivot pin receiver 30 is an inner stiffening ring 32 and an outer stiffening ring 34. Rings 32 and 34 are reinforced by spokes 36 that radiate outwardly from pivot pin receiver 30 and, also, by longitudinal spars 38 that extend from one end of lip 28 to the other. A latticework of cross braces 40 connects rings 32 and 34 to spars 38 and lip 28 to stiffen saddle 12 considerably yet minimize its weight.

Located at each corner of plate 26 is a pair of mounting clip receivers 42 positioned parallel to the longitudinal axis A of saddle 12. Each of receivers 42 includes a tubular sleeve 44 that extends downwardly from plate 26 and is reinforced by cross braces 40. The portion of plate 26 atop each sleeve 44 is recessed to define both a socket into which a mounting clip 20 can be inserted and a circular plug 46 capable of supporting said mounting clip 20.

The bottom of each plug 46 is provided with a pair of C-shaped ramps 48 located 180° apart. Each ramp 48 has a thick central portion 50 and a pair of tapered ends 52 that extend from central portion 50 and smoothly transition into a plug 46. Extending downwardly from each central portion 50 is a pair of key bit keepers 54 positioned side by side along the length of ramp 48 and each being shaped like a miniature one of ramps 48.

Each plug 46 is provided with a keyhole 56 at its center. Each keyhole 56 includes a rectangular notch 58 being positioned midway between ramps 48 and extending from one side of plug 46 to the other. Each keyhole 56 also has a circular bore 60 located at the midpoint of notch 58.

Four mounting clips 20 are connected to saddle 12 with each being respectively located within one receiver 42 at each corner of saddle 12. Each clip 20 has a base 62 adapted for releasable connection to saddle 12 and a pair of arcuate jaws 64 affixed to base 62 for releasable connection to a chair leg 22. As shown, base 62 includes a shank 66 of cruciform outline from the bottom of which a shaft 68 extends downwardly. At the free end of shaft 68 is affixed a key bit 70 being a rod oriented at right angles to shaft 68. Jaws 64, however, enclose a cylindrical space 72 accessed by way of an open mouth 74 located between the free ends of jaws 64 at the top of a clip 20. A chair leg 22 can be eased through mouth 74 and into space 72 for a snap-fit with a clip 20.

The relative dimensions of clip base 62 and mounting clip receiver 42 are important for safely connecting a clip 20 to saddle 12. In this regard, key bit 70 is slightly smaller than notch 58 for passage through notch 58. Similarly, shaft 68 is slightly smaller than circular bore 60 for rotation within bore 60. Finally, the length of shaft 68 must be sufficient to permit key bit 70 to pass fully through notch 58 and, by subsequent rotation of clip 20, adequate to allow the ends of key bit 70 to slide upon ramps 48 to reach a position whereby such rest snugly between keepers 54.

Load-distributing platform 14 comprises an inverted bowl 76 from the periphery of which a wide rim 78 extends outwardly and downwardly and a sealing ring 80 extends upwardly. At the center of bowl 76 is located a pivot pin anchor receiver 82. At spaced intervals around receiver 82, bowl 76 has dimples 84 in its top that are sized to receive and hold ball bearings 86. Spokes 88 that radiate outwardly from pivot pin anchor receiver 82 to the periphery of rim 78 stiffen platform 14.

Platform 14 has a pair of integral handles 90 for ease in carrying apparatus 10. Handles 90 are provided to apparatus 10 by making a pair of slots 92, approximately the size of a human hand, near the periphery of rim 78 and 180° apart. Around the periphery of each slot 92, a ring 94 is affixed to the bottom of rim 78 to reinforce rim 78 and make platform 14 easier to grasp by fingers extended through either of slots 92.

A friction reducing mechanism 96 facilitates the rotation of saddle 12 on pivot pin 16. Mechanism 96 includes ball bearings 86 whose bottoms are set in dimples 84 in platform 14 mentioned hereinabove. Mechanism 96 also includes a circular bearing race 98 joined by screws 100 to the bottom of saddle 12. Race 98 has a circumferential channel 102 for engaging the tops of ball bearings 86. As shown, race 98 is configured such that the top of channel 102 is fully engaged by inner ring 32 to minimize deformation of race 98 under load.

Dust, dirt, and sand are prevented from fouling bearings 86 by an annular seal 104. Seal 104 is a band of resilient material secured, by a press-fit, atop sealing ring 80. Seal 104 has an outwardly extending flange 106 that lightly engages outer stiffening ring 34. Since flange 106 bridges the gap between rings 34 and 80, foreign matter cannot pass between saddle 12 and platform 14 to reach bearings 86 thereby making bearings 86 maintenance-free.

Pivot pin 16 secures saddle 12 to platform 14. Pivot pin 16 comprises a bolt extending downwardly through pivot pin receiver 30 and into pivot pin anchor receiver 82 wherein pivot pin 16 threadably engages a nut 108. To prevent cracking of saddle 12 and platform 14 at points of penetration of pin 16, one washer 110 is provided directly beneath bolt head 112 and another washer 114 provided atop bowl 76. A durable sleeve 116 is also fitted around the threaded portion 118 of pin 16 within receiver 82 to minimize wear as saddle 12 is rotated relative to platform 14 throughout the life of apparatus 10. A cover 120 is fitted over pivot pin 16 to prevent such from becoming fouled.

Use of apparatus 10 is straightforward. First, platform 14 is positioned on a supporting surface 18 such as a sandy beach. Then, chair 24 is set atop apparatus 10 with the bottom of each of its legs 22 being respectively situated over a pair of mounting clip receivers 42 at one end of saddle 12. (It will be assumed, for the sake of the following discussion, that legs 22 fall into alignment with the outermost receivers 42 in saddle 12 though legs 22 on a different chair 24 can have a spacing equivalent to the distance between the innermost receivers 42 or, alternatively, have a spacing equivalent to the distance between an inner pair of receivers 42 and an outer pair of receivers 42.) Now, since the bottoms of legs 22 align themselves with the outermost receivers 42, clips 20 are installed therein if they have not been on a previous occasion. Each clip 20 is secured to saddle 12 in succession by inserting its key bit 70 fully into notch 58 in one of the outermost receivers 42 and, then, by turning the clip 20 until the opposite ends of key bit 70 "snap" between keepers 54. Next, the bottoms of chair legs 22 are pushed through mouths 74 and into spaces 72 provided between jaws 64. Chair 24 can now be easily swiveled 360° around a vertical axis by a user. The entire process of making apparatus 10 ready for use requires just a few seconds to complete.

After use, apparatus 10 is detached from chair 24 by lightly pulling chair legs 22 from clips 20. Chair 24 is now folded for transport and storage with apparatus 10. Apparatus 10, being light in weight, can be easily toted with folded chair 24 by grasping one of handles 90 in platform 14. Being compact in size, apparatus 10 can be easily stored with folded chair 24 in an automobile trunk or closet for immediate reuse. In the event that apparatus 10 becomes dirty, it, being constructed from any materials suitable for outdoor use, can be washed with soap and water prior to storage.

While apparatus 10 has been described with a high degree of particularity, it will be appreciated by those skilled in the art that modifications can be made to apparatus 10. Thus, it is to be understood that the present invention is not limited solely to apparatus 10, but encompasses any and all apparatus embodiments within the scope of the following claims.

I claim:

1. A detachable swivel apparatus for a beach chair, said apparatus comprising:

a load-distributing platform for positioning upon the ground;

a saddle being pivotally secured atop said platform, said saddle having a rectangular plate with a keyhole at each corner thereof; and, a plurality mounting clips being releasably secured to said saddle for grasping the legs of a beach chair, one of said clips being associated with each said keyhole, each of said clips including:

a pair of arcuate jaws for receiving and grasping therebetween one leg of a beach chair;

a shaft being affixed to, and extending downwardly from, said jaws; and, a key bit being affixed to, and extending outwardly from, the bottom of said shaft; and, whereby each said shaft and each said key bit can, in one angular orientation, be slid through a respective one said keyhole and, upon rotation to another angular orientation after being slid through a respective one said keyhole, be prevented from withdrawal through a respective one said keyhole.

2. The swivel apparatus according to claim 1 wherein said saddle includes a plurality of ramps being affixed to the bottom of said plate with a pair of said ramps being respectively located on opposite sides of each said keyhole, and each of said ramps including:

a thick central portion;

a pair of tapered ends extending outwardly from said central portion; and, a pair of keepers being positioned on said central portion and extending downwardly therefrom for selectively receiving one said key bit therebetween.

3. A detachable swivel apparatus for a beach chair, said apparatus comprising:

a load-distributing platform for positioning upon the ground;

a saddle being pivotally secured atop said platform, said saddle having a rectangular plate with a pair of keyholes at each corner thereof, said plate having a longitudinal axis and each said pair of keyholes being respectively centered on a line being substantially parallel to said longitudinal axis; and, a plurality mounting clips being releasably secured to said saddle for grasping the legs of a beach chair, one of said clips being associated with each said pair of keyholes, each of said clips including:

a pair of arcuate jaws for receiving and grasping therebetween one leg of a beach chair;

a shaft being affixed to, and extending downwardly from, said jaws; and, a key bit being affixed to, and extending outwardly from, the bottom of said shaft; and, whereby each said shaft and each said key bit can, in one angular orientation, be slid through a respective one of said keyholes and, upon rotation to another angular orientation after being slid through a respective one of said keyholes, be prevented from withdrawal through a respective one of said keyholes.

4. The swivel apparatus according to claim 3 wherein said saddle includes a plurality of ramps being affixed to the bottom of said plate with a pair of said ramps being respectively located on opposite sides of each said keyhole, and each of said ramps including:

a thick central portion;

a pair of tapered ends extending outwardly from said central portion; and, a pair of keepers being positioned on said central portion and extending downwardly therefrom for selectively receiving one said key bit therebetween.

5. A detachable swivel apparatus for a beach chair, said apparatus comprising:

a load-distributing platform for positioning upon the ground;

a saddle being pivotally secured atop said platform, said saddle having a rectangular plate with a pair of mounting clip receivers at each corner thereof, said plate having a longitudinal axis and each said pair of mounting clip receivers being respectively centered on a line being substantially parallel to said longitudinal axis, each of said mounting clip receivers including:

a tubular sleeve extending downwardly from said plate;

a circular plug closing the top of said tubular sleeve, said circular plug being recessed within said tubular sleeve below the top of said plate, and said plug being provided with a keyhole;

a pair of said ramps each being located on opposite sides of each said keyhole, and each of said ramps including:

a thick central portion;

a pair of tapered ends extending outwardly from said central portion; and, a pair of keepers being positioned on said central portion and extending downwardly therefrom; and, a plurality mounting clips being releasably secured to said saddle for grasping the legs of a beach chair, one of said clips being associated with each said pair of keyholes, each of said clips including:

a pair of arcuate jaws for receiving and grasping therebetween one leg of a beach chair;

a shaft being affixed to, and extending downwardly from, said jaws; and, a key bit being affixed to, and extending outwardly from, the bottom of said shaft; and, whereby each said shaft and each said key bit can, in one angular orientation, be slid through a respective one of said keyholes and, upon rotation to another angular orientation after being slid through a respective one of said keyholes, be prevented from withdrawal through a respective one of said keyholes.

* * * * *